US008467706B2

(12) United States Patent
Wayman

(10) Patent No.: US 8,467,706 B2
(45) Date of Patent: Jun. 18, 2013

(54) HIGH SPEED, HIGH QUALITY IMAGE MONOCHROMATIC PRINTER

(75) Inventor: William H. Wayman, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 210 days.

(21) Appl. No.: 13/152,559

(22) Filed: Jun. 3, 2011

(65) Prior Publication Data

US 2012/0308268 A1 Dec. 6, 2012

(51) Int. Cl.
*G03G 15/01* (2006.01)
*G03G 15/06* (2006.01)

(52) U.S. Cl.
USPC ..... 399/228; 399/222

(58) Field of Classification Search
USPC ..... 399/222, 228, 231
See application file for complete search history.

(56) References Cited

U.S. PATENT DOCUMENTS

| | | | | |
|---|---|---|---|---|
| 6,668,146 | B2 | 12/2003 | Folkins et al. | |
| 2002/0067929 | A1 * | 6/2002 | James et al. | 399/88 |
| 2003/0223781 | A1 * | 12/2003 | Grenek et al. | 399/223 |
| 2005/0135825 | A1 * | 6/2005 | Sekovski et al. | 399/50 |
| 2005/0196182 | A1 * | 9/2005 | Taguchi et al. | 399/12 |

* cited by examiner

*Primary Examiner* — David Gray
*Assistant Examiner* — Sevan A Aydin

(57) ABSTRACT

A printer apparatus includes the use of at least two HSD stations to develop an electrostatic image generated by a single exposure on a photoreceptor in order to enable high speed, high quality monochrome development. A third standby HSD station can be included for increased reliability or be cycled in and out of development allowing on-the-fly cleaning of HSD wires.

12 Claims, 1 Drawing Sheet

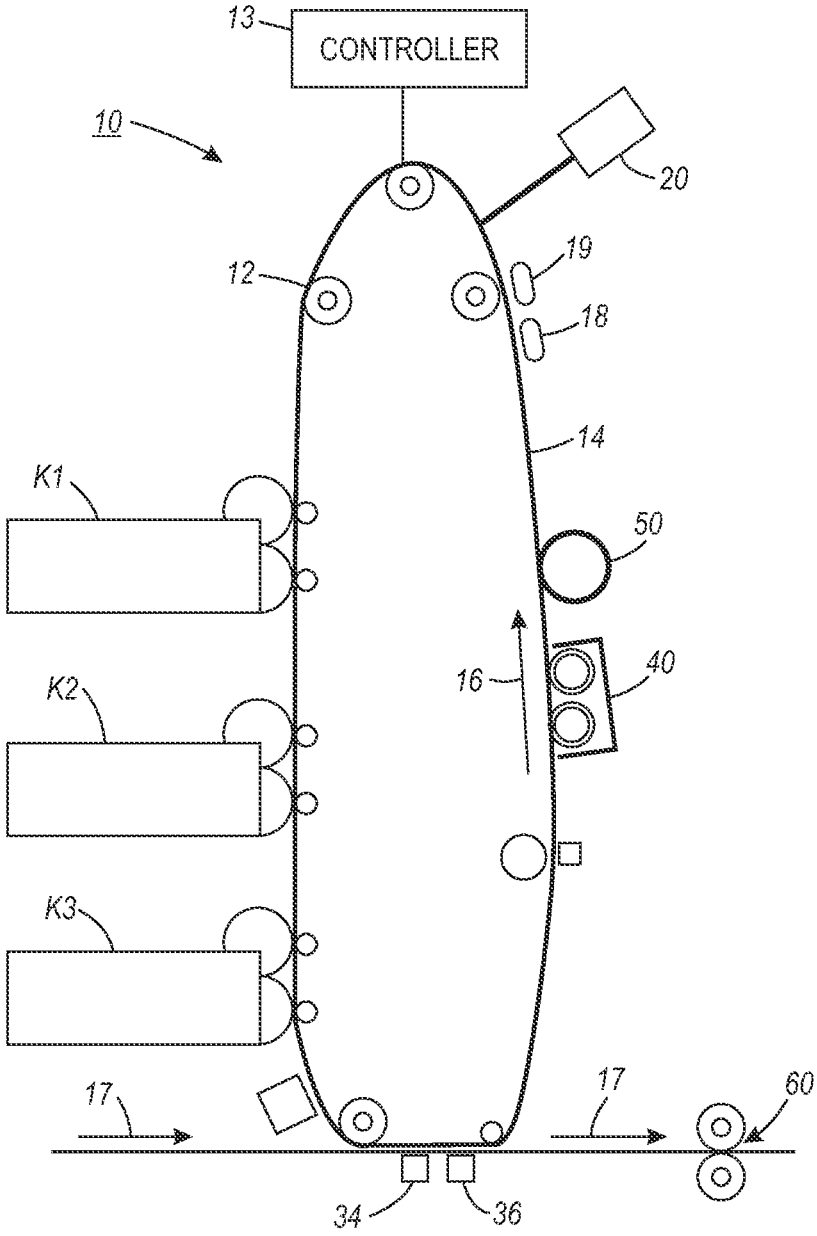
13
CONTROLLER
10
20
12
19
18
14
K1
50
16
40
K2
K3
17
17
60
34
36

HIGH SPEED, HIGH QUALITY IMAGE MONOCHROMATIC PRINTER

BACKGROUND

1. Field of the Disclosure

This disclosure relates in general to an image forming apparatus, such as a printer, and more particularly, to an image forming apparatus employing multiple black developer housings to improve monochromatic image quality.

2. Description of Related Art

Generally, the process of electrostatographic printing includes charging a photoreceptor member to a substantially uniform potential to sensitize the surface thereof. The charged portion of the photoreceptor surface is exposed to a light image from either a scanning laser beam, and LED source, or an original document being produced. This records an electrostatic latent image on the photoreceptor surface. After the electrostatic latent image is recorded on the photoreceptor surface, the latent image is developed. Two-component and single-component developer materials are commonly used for development. A typical two-component developer comprises magnetic carrier granules having toner particles adhering triboelectrically thereto. A single-component developer material typically comprises toner particles. Toner particles are attracted to the latent image, forming a toner powder image on the photoreceptor surface. The toner powder image is subsequently transferred to a copy sheet. Finally, the toner powder image is heated to permanently fuse it to the copy sheet in image configuration.

Image quality in printers has improved in the past by the introduction of hybrid scavengeless development (HSD) as shown, for example, in U.S. Pat. No. 6,668,146 B2. HSD technology develops toner via a conventional magnetic brush onto the surface of a donor roll. A plurality of electrode wires is closely spaced from the toned donor roll in the development zone. An AC voltage is applied to the electrode wires to generate a toner cloud in the development zone. This donor roll generally consists of a conductive core covered with thin (50-200 microns) partially conductive layer. The magnetic brush roll is held at an electrical potential difference relative to the donor roll to produce the field necessary for toner to adhere to the donor roll. The toner layer on the donor roll is then disturbed by electric fields from a wire or set of wires to produce and sustain an agitated cloud of toner particles. Typical AC voltages of the wires relative to the donor are 700-900 Vpp at frequencies of 5-15 kHz. These AC signals are often square waves, rather than pure sinusoidal waves. Toner from the cloud is then developed onto the nearby photoreceptor by fields created by a latent image.

However, even with the advent of hybrid scavengeless development, a problem remains as to how to compete with image quality of offset printing.

BRIEF SUMMARY OF THE DISCLOSURE

Accordingly, and in answer to the above-mentioned problem, a method and apparatus is disclosed that includes the use of at least two HSD stations to develop an electrostatic image generated by a single exposure on a photoreceptor in order to enable high speed, high quality monochrome development. One or two dicorotrons are used to charge the photoreceptor. A ROS (Raster Output Scanner) is used to expose the photoreceptor and is positioned to allow enough time for the photoreceptor electrostatic image to fully form by the time it reaches the first development station. A third standby development station can be included for increased reliability or be cycled in and out of development allowing on-the-fly cleaning of the HSD wires on the inactive station.

The hereinafter disclosed reprographic system that incorporates the disclosed improved method and apparatus for providing high speed, high quality images may be operated by and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'sheet' herein refers to any flimsy physical sheet or paper, plastic, or other useable physical substrate for printing images thereon, whether precut or initially web fed.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. The cited reference, and its references, is incorporated by reference herein where appropriate for teachings of additional or alternative details, features, and/or technical background. What is well known to those skilled in the art need not be described herein.

BRIEF DESCRIPTION OF THE DRAWINGS

Various of the above-mentioned and further features and advantages will be apparent to those skilled in the art from the specific apparatus and its operation or method described in the example below, and the claims. Thus, they will be better understood from this description of the specific embodiment, including the drawing figure (which are approximately to scale) wherein:

The FIGURE is a partial frontal view of an exemplary image forming apparatus that incorporates the improved HSD method and apparatus of the present disclosure.

Referring now to printer 10 in the FIGURE, and in accordance with the present disclosure, marking module 12 controlled by controller 13 includes a charge retentive substrate which could be a photoreceptor belt 14 that advances in the direction of arrow 16 through the various processing stations around the path of belt 14. Dual chargers 18 and 19 charge an area of belt 14 to a relatively high, substantially uniform potential. Next, the charged area of belt 14 passes raster output scanner (ROS) 20 to expose selected areas of belt 14 to a pattern of light, to discharge selected areas to produce an electrostatic latent image. Next, the illuminated area of the belt passes a first HSD developer station K1, which deposits black toner on charged areas of the belt. It is critical for high speed printing, where photoreceptor speeds approach 1000 mm/sec, that ROS 20 is positioned sufficiently upstream of HSD developer station K1 to allow the electrostatic image to fully form on photoreceptor belt 14.

Continued rotation of belt 14 causes the previously illuminated and once toned area to pass a second black HSD station K2 for second deposit of toner. Next, belt 14 is rotated pass a third black HSD station K3. The K3 HSD station is unused and provided to enable wire cleaning cycles "on the fly". Controller 13 cycles through the three development stations, so that two stations are always developing the image while the third is in a cleaning mode or waiting for service. Additionally, the third development station can be kept in standby in case there is a fault in station K1 or station K2 requiring one of them to be shut down. This results in improved machine up-time for the customer.

The development split between HSD stations K1 and K2 is set by process controls. Toner age of the K2 station can be managed by allowing the K2 station to develop at least ⅓ of the image mass.

A conventional inline image sensor can be used to monitor image quality and sends a signal to controller 13. At cycle-up or cycle-down, marking module 12 is checked by controller 13 for uniformity of the three developer stations and chooses the best two for developing images.

As a result of the processing described above, a high quality toner image is now moving on belt 14. In synchronism with the movement of the image on belt 14, copy sheets are fed from a sheet feeder module (not shown) by conventional means in the direction of arrow 17 into contact with the image on belt 14. A corotron 34 charges the sheet to tack the sheet to belt 14 and to move the toner from belt 14 to the sheet. Subsequently, detack corotron 36 charges the sheet to an opposite polarity to detack the sheet from belt 14. The sheet is then fed in the direction of arrow 17 to a downstream fuser 60, which permanently affixes the toner to the sheet with heat and pressure.

Next, cleaner 40 which includes dual electrostatic brushes removes toner that may remain on the image area of belt 14. After cleaning, belt 14 passes a light shock lamp 50 where any residual image is removed from the photoreceptor.

It should now be understood that a method and apparatus has been disclosed that includes the use of two or three black developer housing in a printer for producing high speed, high quality monochrome images. One or two dicorotrons are used to provide uniform photoreceptor charging. In addition, a ROS is positioned such that enough time is allowed for the image to fully form before it reaches the first development station. A third standby development station can be included for increased reliability or be cycled in and out of the development process allowing on-the-fly cleaning of HSD wires on the standby housing.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A xerographic device adapted to print high speed, high quality monochrome images onto copy sheets, comprising:

an imaging apparatus, said imaging apparatus including a charge retentive substrate, a charge device for charging a surface of said charge retentive substrate, and a laser for writing images onto said surface of said charge retentive substrate;

an image development apparatus for developing the images on said surface of said charge retentive substrate, said image development apparatus including three black toner development stations with two of said three black toner development stations being adapted to apply black toner successively to each passing copy sheet; and a transfer device for transferring said images onto said copy sheets; and a fuser for fusing said images to said copy sheets.

2. The xerographic device of claim 1, wherein said plurality of three black toner development stations includes two hybrid scavengeless development devices.

3. The xerographic device of claim 2, including a third hybrid scavengeless development device for standby purposes.

4. An image forming apparatus for producing high speed, high quality images, comprising:

a charge retentive substrate adapted to receive images thereon;

a charger for charging said charge retentive substrate;

a scanner for writing images onto said charge retentive substrate after it has been charged;

a development system for developing said images on said charge retentive substrate, said development system includes a at least three black toner development stations;

a controller, and wherein said controller at startup cycles through said at least three black toner development stations and picks two for service;

a transfer device for transferring said images onto copy sheets; and a fuser for fusing said images onto said copy sheets.

5. The image forming apparatus of claim 1, wherein said at least three black toner development stations includes at least two hybrid scavengeless development devices.

6. The image forming apparatus of claim 5, wherein said development system includes a third of said at least three black toner hybrid scavengeless development stations in standby in order to increase reliability of the development system and machine up-time.

7. The image forming apparatus of claim 1, wherein said images are generated by a single exposure.

8. The image forming apparatus of claim 4, wherein said scanner for writing images onto said charge retentive substrate is a raster-output-scanner.

9. The image forming apparatus of claim 4, wherein said controller picks a third of said at least three black toner hybrid scavengeless development stations for running through a cleaning mode while said picked two black toner hybrid scavengeless development stations are in service.

10. A method for printing images onto copy sheets, comprising:

providing a charge retentive surface;

providing a charger for charging said charge retentive surface;

providing an imaging apparatus for processing and writing images onto said charge retentive surface;

providing an image development apparatus for developing said images, said image developing apparatus including three black toner hybrid scavengeless development stations in order to facilitate the making of high speed, high quality copies of said images;

providing a sensor for monitoring image quality;

providing a controller, and wherein said controller at cycle-up or cycle-down uses signals from said sensor to cycle through said three black toner development hybrid scavengeless stations so that two are always developing said images while the third is in a wire cleaning mode;

providing a transfer device for transferring said images onto said copy sheets; and fusing said image onto said copy sheets.

11. The method of claim 10, including using said third of said three black toner hybrid scavengeless development stations for standby use when not used for wire cleaning.

12. The method of claim 10, wherein said charger for charging said charge retentive surface includes dual charging devices.

* * * * *